US011898819B2

(12) United States Patent
Weinberger

(10) Patent No.: US 11,898,819 B2
(45) Date of Patent: Feb. 13, 2024

(54) SENIOR CITIZEN DEFENDER HANDGUN DEVICE AND USES THEREOF

(71) Applicant: Michael Weinberger, New Orleans, LA (US)

(72) Inventor: Michael Weinberger, New Orleans, LA (US)

( * ) Notice: Subject to any disclaimer, the term of this patent is extended or adjusted under 35 U.S.C. 154(b) by 0 days.

(21) Appl. No.: 17/761,815

(22) PCT Filed: Sep. 14, 2020

(86) PCT No.: PCT/US2020/050704
§ 371 (c)(1),
(2) Date: Mar. 18, 2022

(87) PCT Pub. No.: WO2021/055277
PCT Pub. Date: Mar. 25, 2021

(65) Prior Publication Data

US 2022/0364822 A1 Nov. 17, 2022

Related U.S. Application Data

(60) Provisional application No. 62/947,429, filed on Dec. 12, 2019, provisional application No. 62/933,050, filed on Nov. 8, 2019, provisional application No. 62/903,859, filed on Sep. 22, 2019.

(51) Int. Cl.

| | |
|---|---|
| ***F41C 23/16*** | (2006.01) |
| ***F41A 13/12*** | (2006.01) |
| ***F41C 27/00*** | (2006.01) |

(52) U.S. Cl.
CPC ..... *F41C 23/16* (2013.01); *F41A 13/12* (2013.01); *F41C 27/00* (2013.01)

(58) Field of Classification Search
CPC ..... F41C 23/16; F41C 27/00; F41A 13/12
See application file for complete search history.

(56) References Cited

U.S. PATENT DOCUMENTS 2,056,975 A * 10/1936 Michal, Jr. ..... F41C 23/12 42/106
5,107,612 A * 4/1992 Bechtel ..... F41G 11/003 42/146
5,355,609 A * 10/1994 Schenke ..... F41G 1/35 362/110
5,622,000 A * 4/1997 Marlowe ..... F41G 1/35 42/117
5,735,070 A * 4/1998 Vasquez ..... F41G 1/345 42/132
6,385,892 B1 * 5/2002 Vendetti ..... F41C 27/00 42/86
6,655,069 B2 * 12/2003 Kim ..... F41G 11/003 42/114
6,671,991 B1 * 1/2004 Danielson ..... F41C 23/00 42/117
6,785,997 B2 * 9/2004 Oz ..... F41G 1/35 89/37.03
6,851,214 B2 * 2/2005 Oz ..... F41G 1/35 42/146
7,264,369 B1 * 9/2007 Howe ..... H01H 9/06 362/205
D585,517 S * 1/2009 Faifer ..... D22/108
(Continued)

*Primary Examiner* — Michelle Clement
(74) *Attorney, Agent, or Firm* — David M. Stein

(57) ABSTRACT

This invention is directed to a handgun device and uses thereof.

2 Claims, 15 Drawing Sheets

(56) References Cited

U.S. PATENT DOCUMENTS 7,559,167 B1 * 7/2009 Moody ..... F41C 23/16 42/71.01
7,578,090 B1 * 8/2009 Romaszka ..... F41G 11/003 42/96
7,784,390 B1 * 8/2010 Lowell ..... F41H 13/0068 42/84
7,900,390 B2 * 3/2011 Moody ..... F41A 23/08 42/71.01
D642,651 S * 8/2011 Faifer ..... D22/108
D643,497 S * 8/2011 Fitzpatrick ..... D22/108
7,987,627 B2 * 8/2011 Woodmansee, III ... F41C 27/00 42/114
8,109,032 B2 * 2/2012 Faifer ..... G03B 17/563 42/114
8,117,782 B2 * 2/2012 Gross ..... F41G 11/003 42/114
D665,043 S * 8/2012 Fitzpatrick ..... D22/108
D670,785 S * 11/2012 Fitzpatrick ..... D22/108
D672,838 S * 12/2012 Mayberry ..... D22/108
8,393,108 B1 * 3/2013 Wilson ..... F41G 11/003 42/111
8,438,769 B1 * 5/2013 Ghannam ..... F41G 11/003 42/74
8,510,979 B1 * 8/2013 Mortimer ..... F41H 9/10 42/114
8,522,467 B1 * 9/2013 Christensen ..... F41C 23/16 42/72
8,528,246 B2 * 9/2013 Telles ..... F41C 23/16 42/71.01
D691,236 S * 10/2013 Fitzpatrick ..... D22/108
8,683,733 B2 * 4/2014 Gross ..... F41G 11/003 42/114
8,857,096 B2 * 10/2014 McClintock ..... F41G 11/003 42/72
8,959,820 B2 * 2/2015 Larson, Jr. ..... F41A 3/66 42/72
9,062,933 B1 * 6/2015 Allen ..... F21V 21/34
9,170,073 B2 * 10/2015 Mangold ..... F41C 27/00
9,182,194 B2 * 11/2015 Moore ..... F41G 1/35
9,194,652 B2 * 11/2015 Esserman ..... F41C 23/16
D745,623 S * 12/2015 Flores ..... D22/108
D745,624 S * 12/2015 Flores ..... D22/108
D745,629 S * 12/2015 Barfoot ..... D22/108
9,273,930 B2 * 3/2016 Jiminez ..... F41G 11/003
D755,334 S * 5/2016 Kielsmeier ..... D22/108
9,341,439 B2 * 5/2016 Michal ..... F41C 23/16
9,341,440 B2 * 5/2016 Moore ..... F41G 11/003
9,464,864 B2 * 10/2016 Merlino ..... F41C 23/16
9,546,848 B1 * 1/2017 Burger, Sr. ..... F41G 11/003
9,581,412 B2 * 2/2017 Cheng ..... F41C 27/00
9,696,111 B2 * 7/2017 Saadon ..... F41C 23/12
9,696,118 B2 * 7/2017 Keeney ..... F41G 11/003
D803,971 S * 11/2017 Saadon ..... F41C 23/16 D22/108
9,835,411 B2 * 12/2017 Larson, Jr. ..... F41G 1/17
9,841,254 B2 * 12/2017 Moore ..... F41C 23/22
9,857,146 B1 * 1/2018 Shelton ..... F41G 11/003
9,891,020 B2 * 2/2018 Jen ..... F41C 23/16
10,082,363 B2 * 9/2018 Burgess ..... F41G 11/003
10,184,753 B2 * 1/2019 Krebs ..... F16B 2/065
10,190,840 B1 * 1/2019 Renteria ..... F41A 23/02
10,222,171 B2 * 3/2019 Chavez ..... F41G 1/35
10,254,085 B2 * 4/2019 Willmann ..... F41G 11/004
10,267,594 B2 * 4/2019 Saadon ..... F41C 23/12
10,393,473 B2 * 8/2019 Maggiore ..... F41G 3/08
D860,375 S * 9/2019 Chavez ..... D22/108
10,480,897 B2 * 11/2019 Keeney ..... F41C 27/00
D877,279 S * 3/2020 Bofill ..... D22/108
10,612,761 B1 * 4/2020 Worman ..... F21V 19/004
10,655,937 B2 * 5/2020 Anderson ..... F41G 11/003
10,670,251 B1 * 6/2020 Hawk ..... F21L 4/005
10,788,286 B2 * 9/2020 Molina ..... F41A 35/02
10,845,157 B2 * 11/2020 Chavez ..... F41C 23/16
D906,562 S * 12/2020 Hawk ..... D22/108
10,955,217 B2 * 3/2021 Saadon ..... F41C 23/14
D915,541 S * 4/2021 Chavez ..... D22/109
11,009,315 B1 * 5/2021 Huang ..... F21S 9/02
11,047,638 B1 * 6/2021 Xu ..... F41G 1/35
11,118,859 B1 * 9/2021 Hawk ..... F21V 23/0485
11,274,901 B2 * 3/2022 Burgess ..... F41G 1/36
D969,953 S * 11/2022 Fogg ..... F41C 27/00 D22/108
D969,954 S * 11/2022 Fogg ..... D22/108
2006/0053673 A1 * 3/2006 Murello ..... F41C 27/00 42/71.01
2009/0122527 A1 * 5/2009 Galli ..... F41G 11/003 362/110
2009/0307954 A1 * 12/2009 Wang ..... F41G 11/003 42/90
2011/0107643 A1 * 5/2011 Fitzpatrick ..... F41C 23/16 42/72
2013/0205636 A1 * 8/2013 Shull ..... F41C 23/16 42/72
2017/0016695 A1 * 1/2017 Willits ..... F41C 23/16
2017/0023330 A1 * 1/2017 Merlino ..... F41C 23/16
2017/0082399 A1 * 3/2017 Moore ..... F41G 1/36
2019/0242674 A1 * 8/2019 Berean ..... F41G 11/003
2019/0390935 A1 * 12/2019 Purkiss ..... F41C 23/16
2020/0173755 A1 * 6/2020 Gonzales ..... F41C 23/16
2020/0200508 A1 * 6/2020 Teetzel ..... F41G 1/36
2020/0408489 A1 * 12/2020 Hovsepian ..... F41G 1/35
2021/0003370 A1 * 1/2021 Martindale ..... F41G 1/02
2021/0116214 A1 * 4/2021 Mock ..... F41G 1/35
2021/0222998 A1 * 7/2021 Theisinger ..... F41G 1/35
2021/0302121 A1 * 9/2021 Saadon ..... F41C 23/14
2021/0381800 A1 * 12/2021 Holmes ..... F41C 23/14
2022/0325979 A1 * 10/2022 Tasyagan ..... F41C 23/16
2023/0047874 A1 * 2/2023 Sakiewicz ..... G01S 19/17

* cited by examiner

SENIOR CITIZEN DEFENDER HANDGUN DEVICE AND USES THEREOF

This application claims priority to U.S. provisional patent application 62/947,429, filed on Dec. 12, 2019; U.S. provisional patent application 62/933,050, filed on Nov. 8, 2019, and U.S. provisional patent application 62/903,859, filed on Sep. 22, 2019, the entire contents of each of which are incorporated herein by reference.

All patents, patent applications and publications cited herein are hereby incorporated by reference in their entirety. The disclosures of these publications in their entireties are hereby incorporated by reference into this application in order to more fully describe the state of the art as known to those skilled therein as of the date of the invention described and claimed herein.

This patent disclosure contains material that is subject to copyright protection. The copyright owner has no objection to the facsimile reproduction by anyone of the patent document or the patent disclosure as it appears in the U.S. Patent and Trademark Office patent file or records, but otherwise reserves any and all copyright rights.

FIELD OF THE INVENTION

This invention is directed to a handgun device and uses thereof.

BACKGROUND OF THE INVENTION

Few events are more terrifying to a senior citizen or disabled person than a criminal home invasion. This is because the elderly and disabled are among our most vulnerable citizens. Unfortunately, many seniors and disabled individuals do not have the finger dexterity, muscle strength or vision skills to control and use a handgun well, much less a large and heavy shotgun or rifle. Also, attempting to control and aim both a handgun and a laser from one contact area is not ideal. The present disclosure addresses this, as well as many other, unmet needs.

SUMMARY OF THE INVENTION

Aspects of the invention are drawn to a handgun device. In embodiments, the handgun device comprises a Finger Rest Area and a Rail situated forward of the Finger Rest Area. In embodiments, the handgun device comprises a Finger Rest Area and one or more accessories situated forward of the Finger Rest Area. In embodiments, the handgun device can comprise one or more accessories situated forward of the Finger Rest Area and also a Rail.

In embodiments, the handgun device is attached to a gun. For example, the handgun device can be attached to the gun by one or more attachment mechanisms, friction, or both. Non-limiting examples of the attachment mechanisms comprise a screw, a pin, a spring-loaded clip, a clip, or a combination thereof.

In embodiments, the handgun device is attached to some portion of the gun, such as the barrel of the gun, a stock attached to the gun, the metal portion under the barrel of the gun, or a combination thereof. In embodiments, the handgun device is attached to the rail of a gun. In embodiments, the handgun device is attached to the trigger guard of a gun.

In embodiments, the handgun device is manufactured as part of the gun.

In embodiments, the Finger Reset Area is situated forward of the trigger guard.

Embodiments of the handgun device can further comprise one or more Finger Stops. The finger stops can comprise one or more protrusions, such as a physical barrier or lip.

In embodiments, the one or more finger stops are located at the end of the Finger Rest Area, at the muzzle end of the Receiving Tube (i.e., opposite of the user end), or both.

Embodiments of the handgun device can further comprise a Receiving Tube. For example, the Receiving Tube can comprise a lumen having one end closer to the user's chest (i.e., user end) and an opposite end further from the user's chest (i.e., muzzle end). In embodiments, the receiving tube is situated around the gun barrel. In embodiments, the Receiving Tube is situated above the Finger Rest Area. In embodiments, the Finger Rest Area is situated forward of the trigger guard of the handgun.

In embodiments, the top side of the Receiving Tube can comprise a Front Sight Cut Out.

In embodiments, the handgun device can comprise one or more ventilation holes. For example, wherein the one or more ventilation holes can be in communication with the lumen of the Receiving Tube. The ventilation holes can be circular, square, or rectangular.

In embodiments, the interior surface of the Receiving Tube comprises one or more ventilation channels. For example, the ventilation channels can comprise one or more linear ventilation channels, one or more circular ventilation channels, or both.

In embodiments, the Finger Rest Area is textured. For example, a textured finger rest area can help the user position his or her fingers close to a laser aiming light.

In embodiments, the handgun device further comprises a Rear Air Intake channel. For example, the Rear Air Intake channel can be in communication with the lumen of the Receiving Tube.

In embodiments, the Rear Air Intake channel can be located near the Finger Rest Area.

Embodiments of the handgun device can further comprise one or more Accessories attached to the Rail. Non-limiting examples of such Accessories can be electronics, such as camera, laser, flashlight, or voice recorder.

In embodiments, the Rail is situated forward of the finger rest area.

In embodiments, the Rail is configured to receive one or more Accessories for attachment thereto. Non-limiting examples of such Accessories comprises a light, laser, voice recorder, camera, or any combination thereof.

In embodiments, the handgun device is configured to be reversibly attached to a handgun.

In embodiments, the handgun device is integral with a handgun.

In embodiments, the Receiving Tube of the handgun device comprises a cylindrical barrel.

Further, aspects of the invention are drawn to a handgun comprising the handgun device described herein. For example, the handgun comprises the device of FIG. 1, FIG. 7, or FIG. 17. For example, the handgun comprises the handgun of FIG. 3, FIG. 4, FIG. 8, FIG. 9, or FIG. 18.

Other objects and advantages of this invention will become readily apparent from the ensuing description.

DETAILED DESCRIPTION OF THE INVENTION

Figure 1:
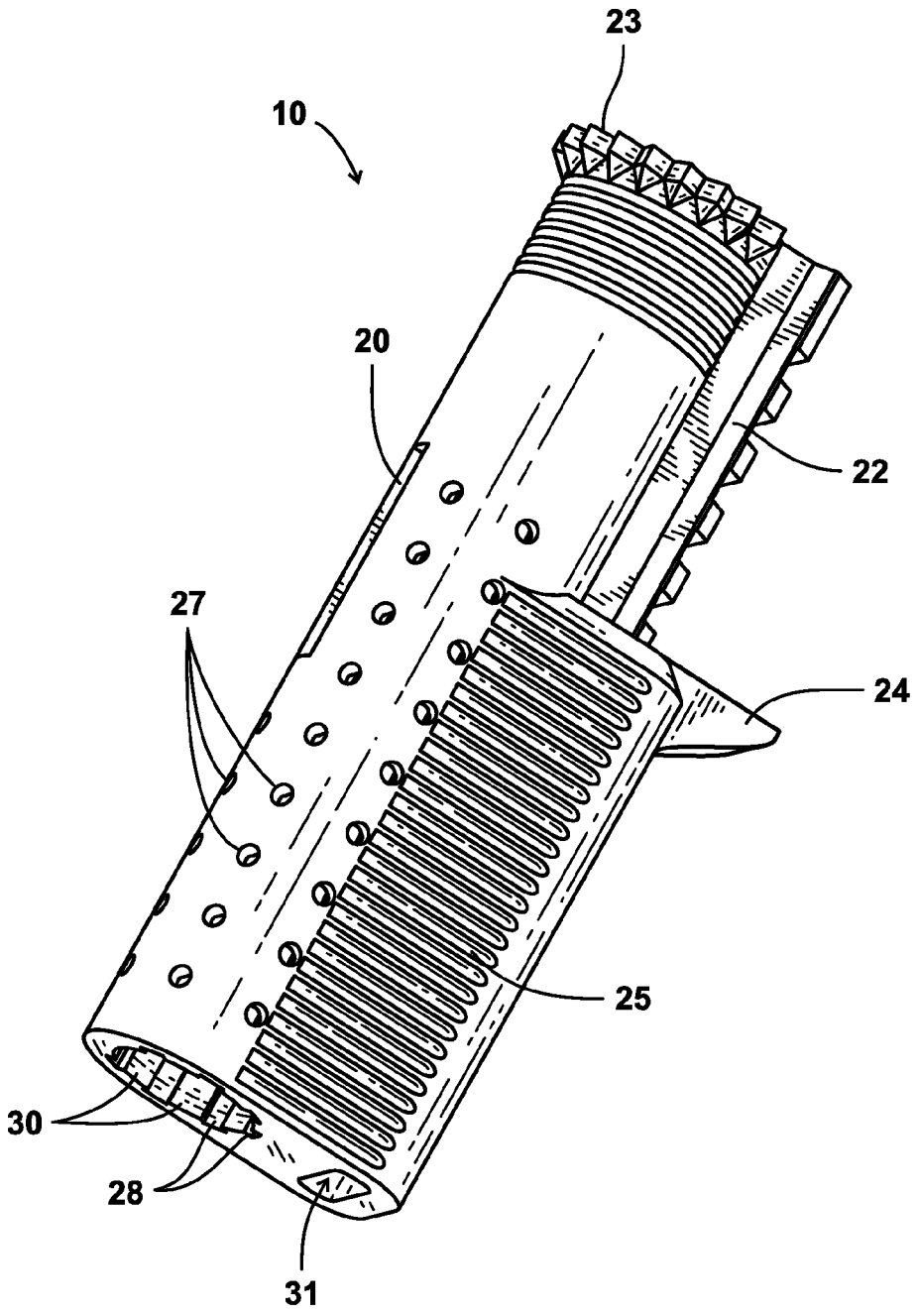
FIG. 1 is a side perspective view of an embodiment of the present invention.

Few events are more terrifying to a senior citizen or disabled person than a criminal home invasion. This is because the elderly and disabled are among our most vulnerable citizens.

Although this vulnerability may be lessened by owning a handgun, such as for home defense purposes, some seniors and disabled individuals do not have the finger dexterity, muscle strength or vision skills to control and use a handgun well, much less a large and heavy shotgun or rifle.

Although controlling a handgun can be made easier by attaching a laser aiming device or other accessory, such as a flashlight, current handgun-laser combinations still leave many problems unsolved. For example, a laser is of limited value if an elderly person's hand trembles and the laser aiming dot moves excessively. Further, the handgun accessories can be difficult to control if the user's fingers are far removed from the control switches of the accessories.

Currently, handgun-laser combinations are controlled by grasping one location, the shooting "grip" of the handgun. Several examples of grips, which are generally perpendicular to the barrel axis and rearward of the trigger, are shown by Ruger in U.S. Pat. No. 4,771,562, in FIGS. 3 and 27.

Attempting to control and aim both the handgun and the laser solely from the shooting grip of the handgun can be difficult, especially for those with frailties, such as weakened hand strength, poor finger dexterity, or diminished eyesight. Examples of such individuals include senior citizens and disabled citizens. It would be easier for these individuals if one hand controlled the shooting action of the handgun (such as pulling the trigger) while the other hand controlled the accessory, such as the laser aiming accessory. As described in the examples and embodiments herein, the present invention accomplishes this and many other goals.

Detailed descriptions of one or more preferred embodiments are provided herein. It is to be understood, however, that the present invention can be embodied in various forms. Therefore, specific details disclosed herein are not to be interpreted as limiting, but rather as a basis for the claims and as a representative basis for teaching one skilled in the art to employ the present invention in any appropriate manner.

The singular forms "a", "an" and "the" include plural reference unless the context clearly dictates otherwise. The use of the word "a" or "an" when used in conjunction with the term "comprising" in the claims and/or the specification may mean "one," but it is also consistent with the meaning of "one or more," "at least one," and "one or more than one."

Wherever any of the phrases "for example," "such as," "including" and the like are used herein, the phrase "and without limitation" is understood to follow unless explicitly stated otherwise. Similarly, "an example," "exemplary" and the like are understood to be nonlimiting.

The term "substantially" allows for deviations from the descriptor that do not negatively impact the intended purpose. Descriptive terms are understood to be modified by the term "substantially" even if the word "substantially" is not explicitly recited.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a process involving steps a, b, and c" means that the process includes at least steps a, b and c. Wherever the terms "a" or "an" are used, "one or more" is understood, unless such interpretation is nonsensical in context.

As used herein the term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

For purposes of the present disclosure, it is noted that spatially relative terms, such as "up," "down," "right," "left," "beneath," "below," "lower," "above," "upper," "forward," "behind," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Aspects of the invention are drawn to a device for attachment to a handgun, such as the barrel of a handgun. The device can be referred to as a "handgun device" or "handgun attachment". In embodiments, the handgun device can be attached to the rail of the gun, or can be attached to the triggergaurd of the gun. The device is separate and distinct from the shooting grip. For example, whereas the shooting grip is generally perpendicular to the barrel axis and rearward of the trigger, the device for attachment to a handgun described herein can be generally parallel to the barrel axis and immediately forward of the trigger guard.

Features of the handgun device described herein comprise: (i) a Finger-Rest Area configured to position the fingers of the non-shooting hand near a rail or accessory; (ii) a Rail, that can be configured to attach or receive an accesspry, and (iii) optionally, at least one Finger Stop that can be configured to prevent unwanted finger movement. Exemplary accessories for such attachment include, but are not limited to, a laser aiming device, flashlight, camera, or combination thereof. In embodiments, the rail is configured to reversibly receive and hold or attach an accessory thereto. In alternate embodiments, the accessory can be provided in place of the rail. In certain embodiments, the finger rest area is located immediately forward of the trigger guard following attachment to the handgun. The Rail is forward of the Finger-Rest.

Referring to the FIG. 1 embodiment of the present invention, the handgun device 10 is shown with the Finger Rest Area 25 near the Rail 22 which is where an accessory, such as a laser, flashlight, camera, or other accessory can be attached to the invention. In the FIG. 1 embodiment, a first Finger Stop 24 prevents excessive movement of the fingers forward of the finger rest area. The FIG. 1 embodiment further includes a second Finger Stop 23, which can be configured to prevent finger movement in front of the device. Alternate embodiments can comprise only a single finger stop.

As shown in FIG. 1, embodiments can include a Front Sight Cut Out 20 configured to accommodate a handgun's removable front sight. In embodiments, the Front Sight Cut Out permits the handgun's removable front sight to be attached to the handgun following attachment of the presently disclosed handgun device. In one example, the handgun device can be configured to snugly slip over the handgun's barrel to permit attachment thereto. For example, the Receiving Tube is configured to snugly slip over the handgun's barrel to permit attachment thereto. For example, in the embodiment shown in FIG. 1 the invention is mounted by surrounding a gun barrel with the Receiving Tube of the device. The gun barrel gets hot when it is used, so ventilation for the barrel is needed in this embodiment. The remaining parts in FIG. 1 are more easily explained by referring to FIG. 2.

Figure 2:
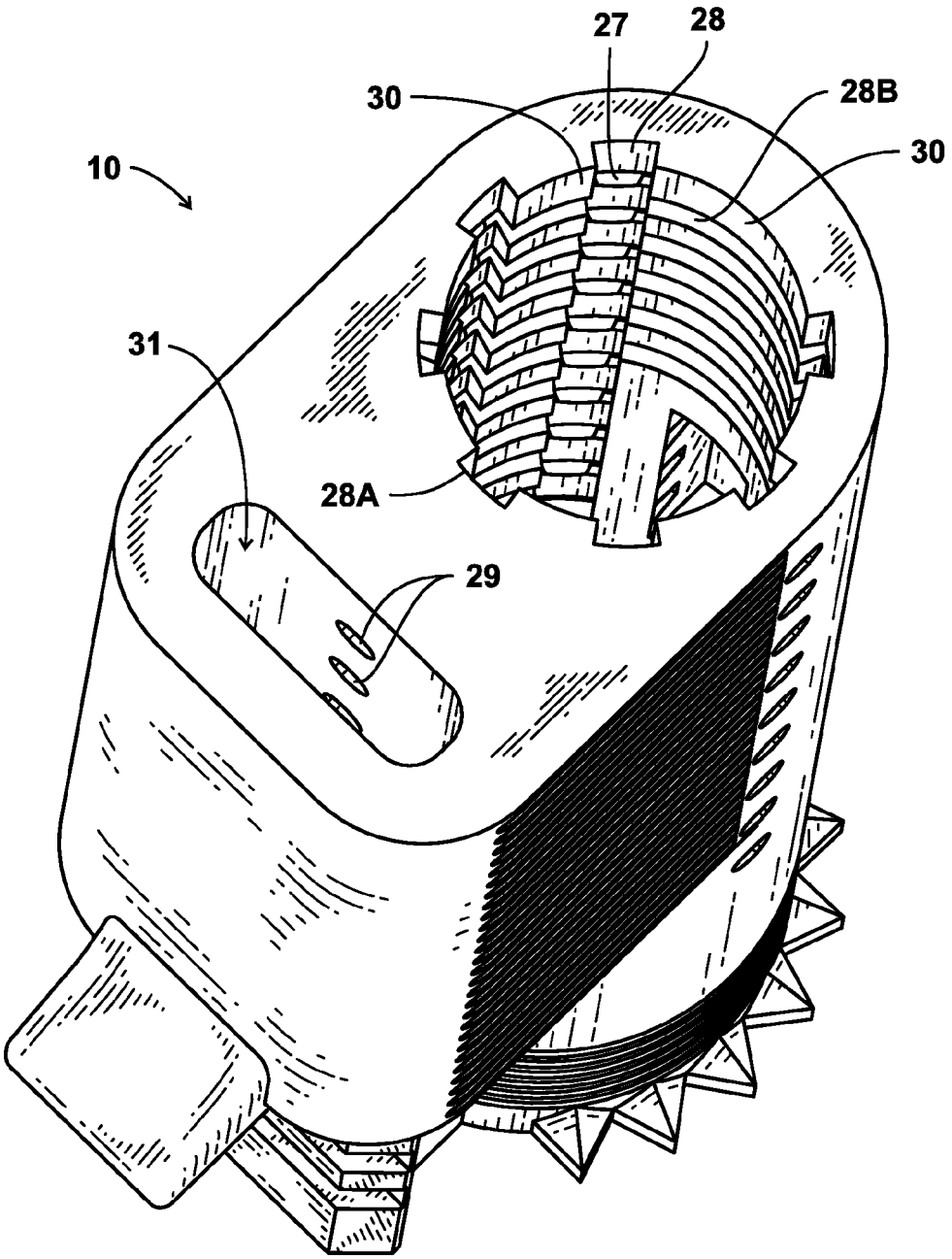
FIG. 2 is an enlarged view of the rear of an embodiment, which is the portion closest to the user's chest, the front portion being further from the user's chest.

FIG. 2 is an enlarged view of the rear of the invention showing the Rear Air Intake 31 which allows air to enter the presently disclosed handgun device to ventilate a warm gun barrel. In one exemplary embodiment, the air travels through the Ventilation Connectors 29, into the Lower Ventilation Channel 28A, and from there continues to circulate around the gun barrel through the Circular Ventilation Channels 28B, the Lineal Circulation Channels 28, or a combination thereof, until the warm air escapes through a plurality of Ventilation Holes, 27. The Receiving Tube itself can be at least partially held in position via contact with one or more Barrel Contacts 30.

Alternative methods of providing air flow around the gun barrel are generally understood by those skilled in the art. Indeed, there are countless suitable configurations to permit the flow of air to cool a gun barrel. See, for example, US20180195832A1, for a series of openings around a barrel to ventilate the barrel.

Figure 16:
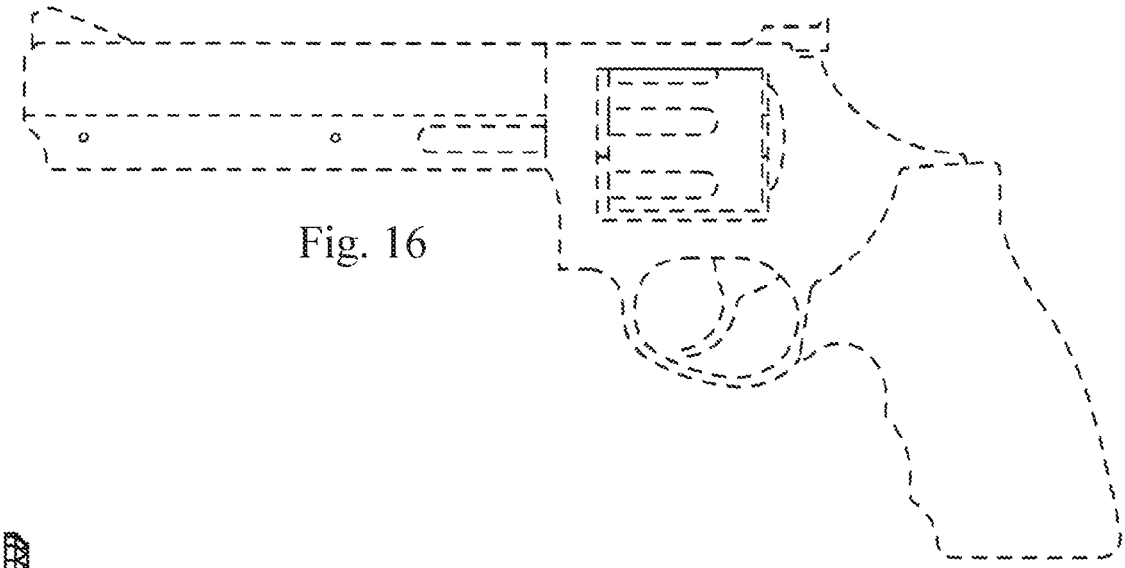
FIG. 16 shows a revolver type handgun with a metal portion thereof under the revolver's barrel, and with the metal under the barrel having two holes to accept screws.
Figure 17:
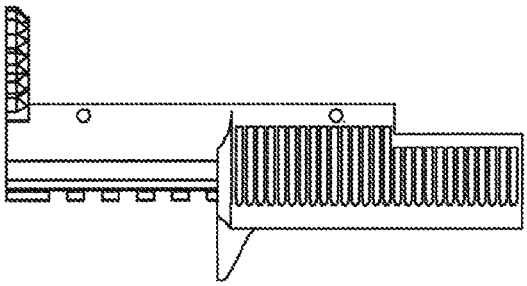
FIG. 17 shows an embodiment of the handgun device made for attachment to the above referenced revolver handgun.
Figure 18:
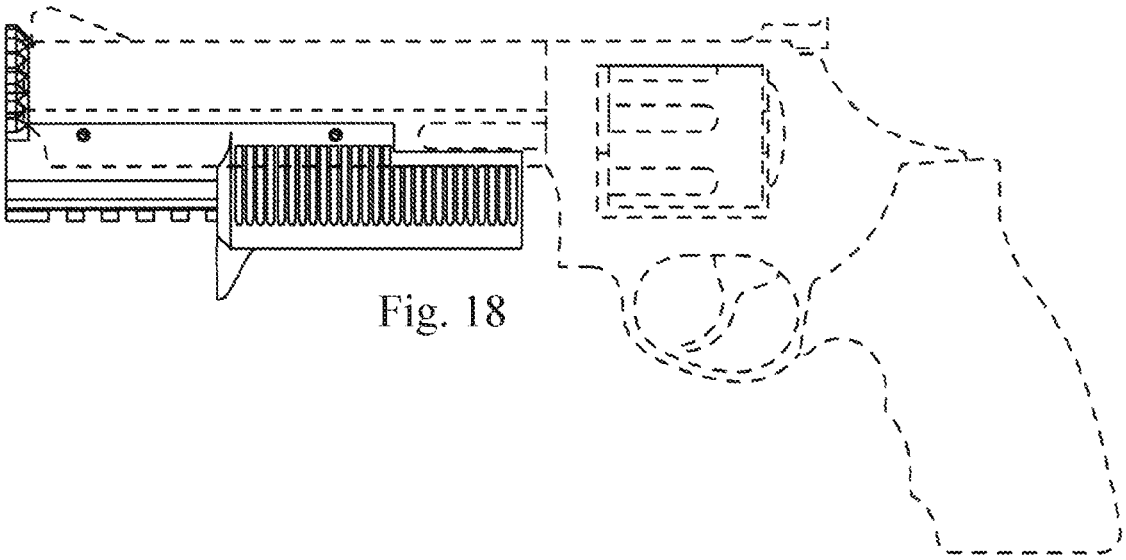
FIG. 18 shows an embodiment of the device attached to the above referenced revolver.
Figure 19:
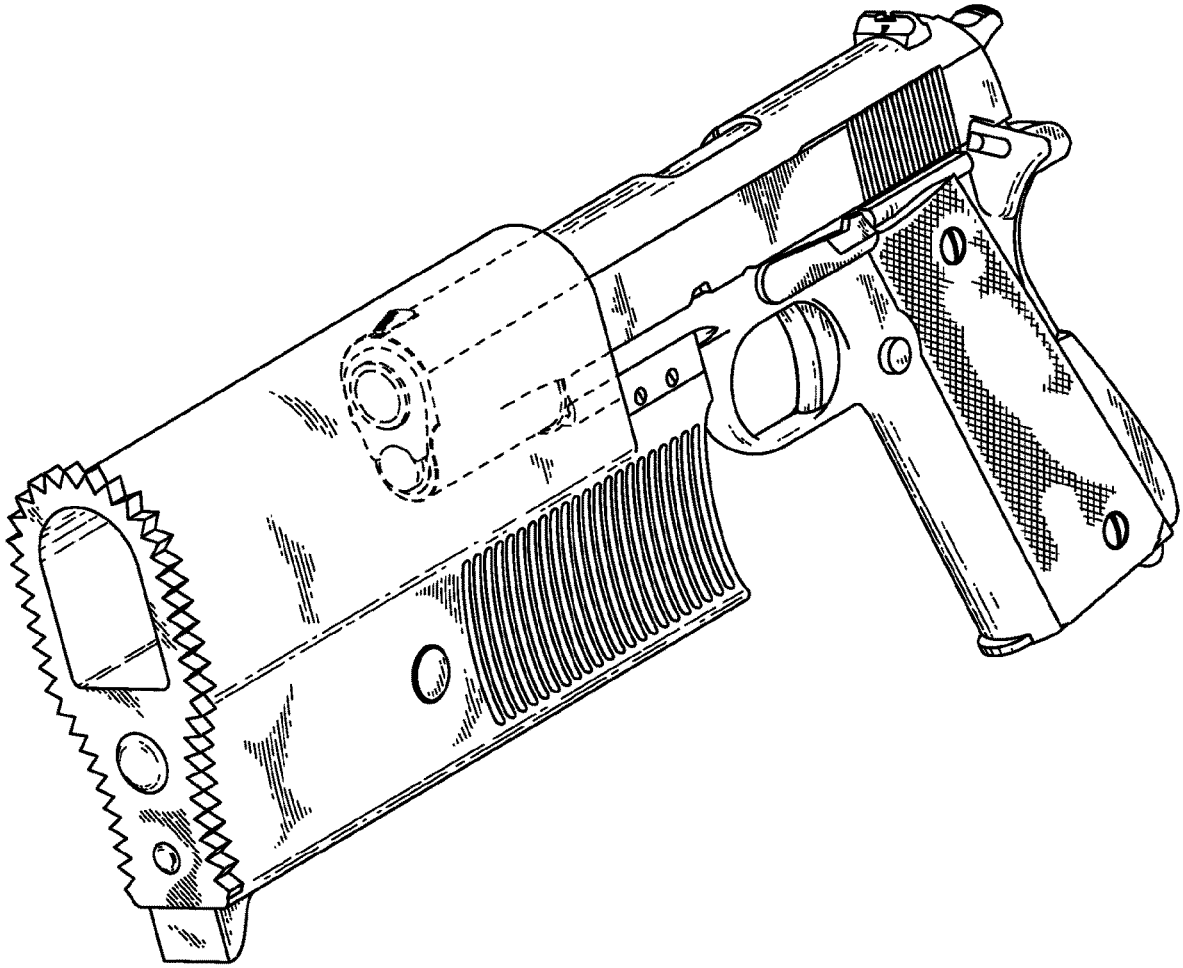
FIG. 19 shows an embodiment of the device attached to the rail of the gun. For example, this embodiment is configured so that the device can be attached with two screws to the rail of a gun, such as a semi-auto pistol. In this embodiment, the device has an Accessory, such as a laser and flashlight, already built into it.
Figure 20:
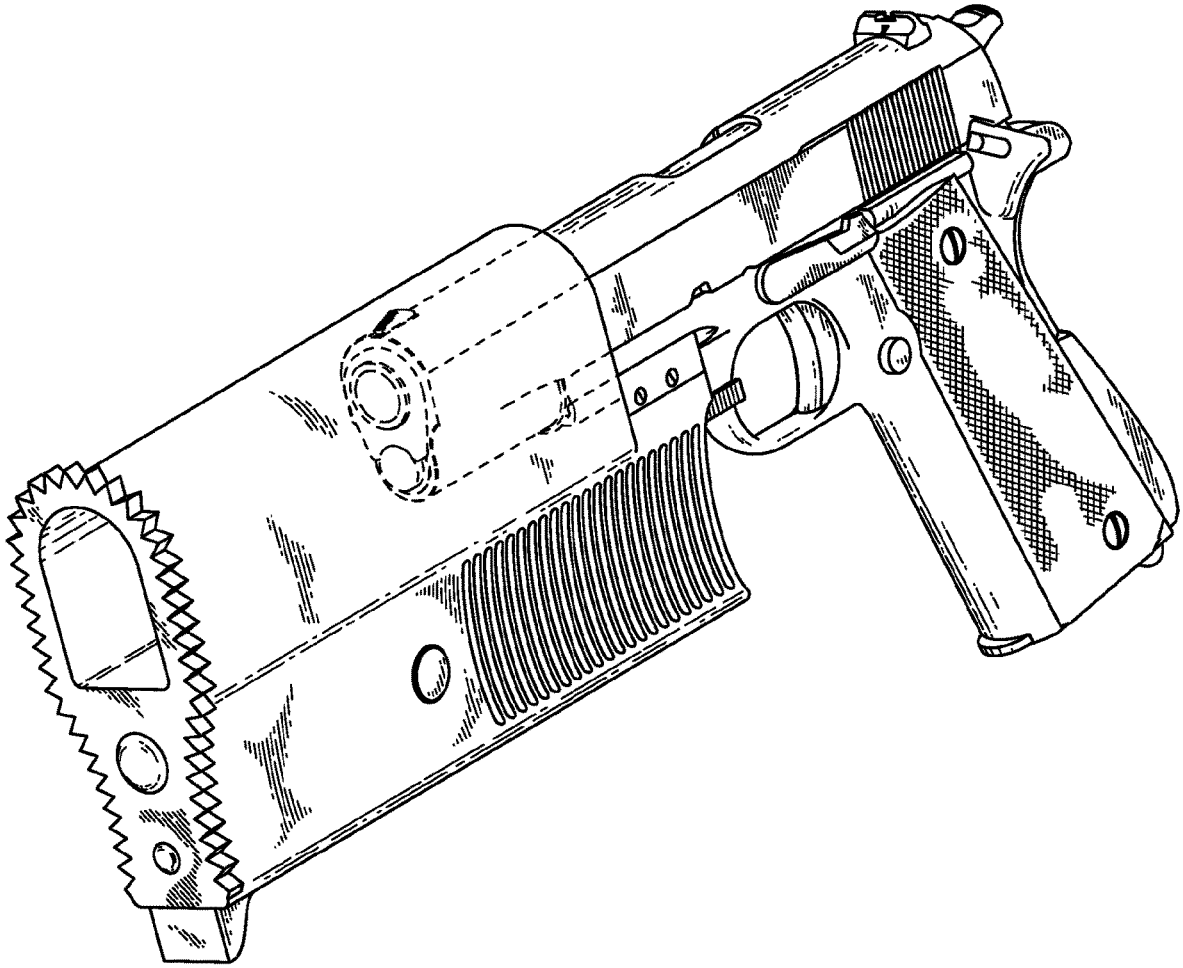
FIG. 20 shows an embodiment of the device attached to the trigger guard. For example, in this embodiment, the device is configured so that it can be attached with two screws to the rail of a gun, such as a semi-auto pistol, and also clipped onto the trigger guard of the gun. In this embodiment, the invention has an Accessory, such as a laser and flashlight, already built into it.
Figure 21:
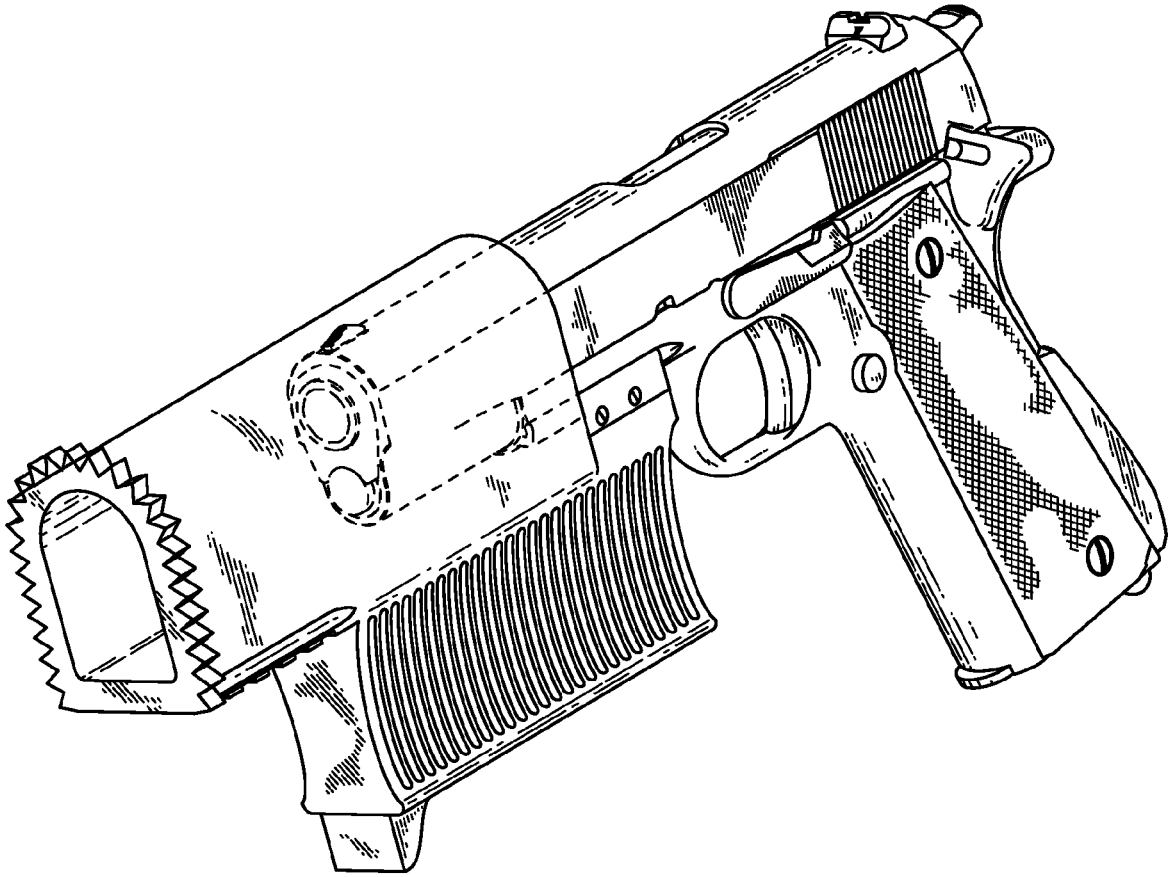
FIG. 21 shows an embodiment of the device configured so that it can be attached with two screws to the rail of a gun, such as a semi-auto pistol, and where the device itself has its own rail where a laser, flashlight or other accessory can be attached to the device.

Referring to FIGS. 16, 17 and 18, the handgun device can comprise a Finger Rest Area, a Rail (or electronics), and, optionally, Finger Stops without further comprising a Receiving Tube. In the embodiment depicted here, the invention can be mounted to a revolver type handgun with a long piece of metal. As shown herein, there are two holes in the metal under the barrel. The invention cups the metal portion under the barrel and is attached thereto, such as screwed to it using two holes for the screws.

Figure 22:
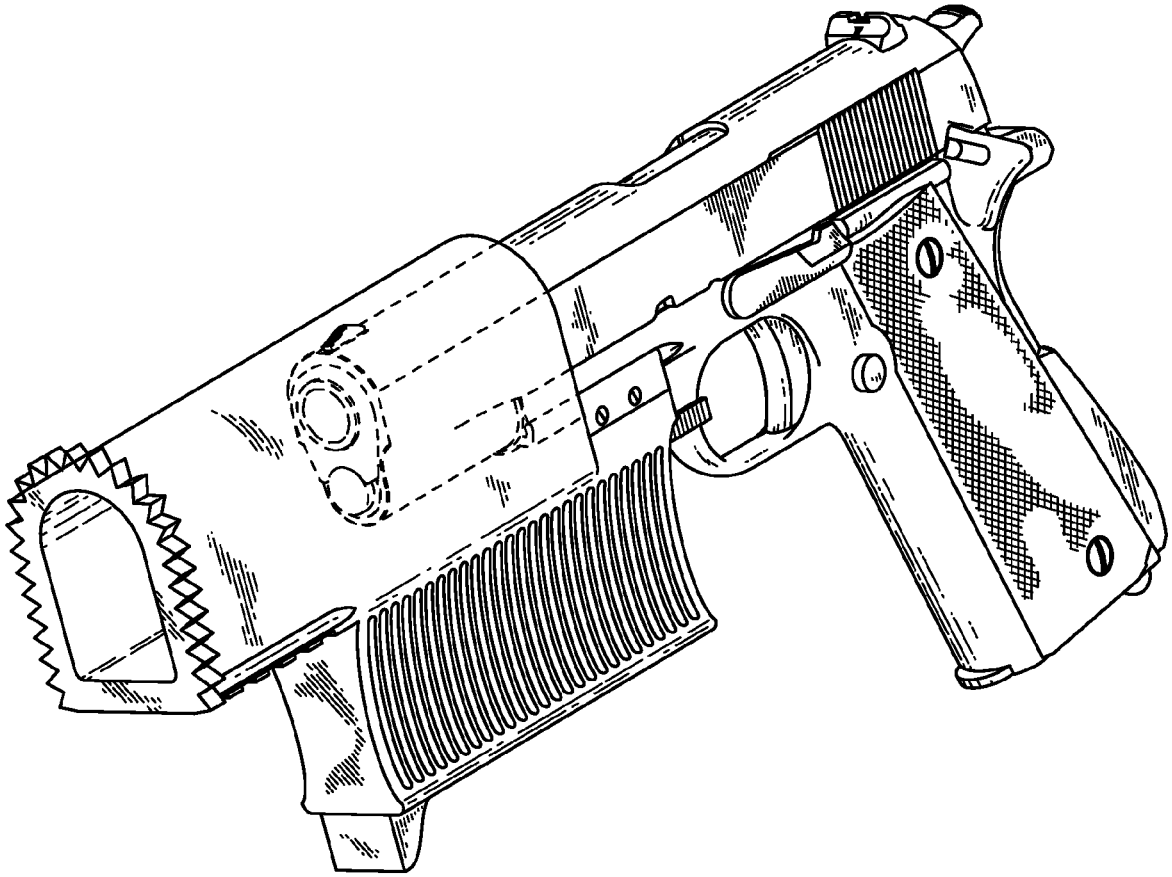
FIG. 22 shows an embodiment of the device configured so that it can be attached with two screws to the rail of a gun, such as a semi-auto pistol, and also clipped onto the trigger guard of the gun, where the device itself has its own rail where a laser, flashlight or other accessory can be attached to the device.

Referring to FIGS. 22 and 24, the handgun device itself can have a rail to which a user can attach one or more Accessories, such as a light, laser, or camera.

Referring to the figures, the skilled artisan will recognize that how the handgun device herein is attached to a gun is generally dependent on the type of gun to be used. For example, the type of guns to which the handgun device can attach to can be a semi-automatic weapon, a pistol, a revolver, a handgun having a substantially exposed barrel and lacking a forward grip, and the like.

As shown in the figures, the handgun device is separate and distinct from the shooting grip. Whereas the shooting grip is generally perpendicular to the barrel axis and rearward of the trigger, the handgun device can be generally parallel to the barrel axis. The device can be further disposed immediately forward of the trigger guard.

In another embodiment a laser or flashlight may take the place of a rail and other miniature electronics may also be added, such as a camera.

In embodiments, the Finger Rest Area is rearward of the rail where an accessory, such as a light or laser, can be mounted. In such embodiments, the Finger Rest Area handgun device is situated in close proximity to the buttons or switches, for example, that control the accessory (such as turning the laser on or off, or controlling the light, such as flashing or steady).

In embodiments, the handgun device can be manufactured to receive, or manufactured with, one or more accessories. For example, the accessory can be a laser, flashlight, voice recorder, or camera. In embodiments, the accessory is controlled by an "accessory controlling device", comprising a button, switch, or dial, that can be attached to or manufactured on the handgun device. For example, an embodiment can comprise a laser aiming device for attachment to a handgun that is separate and distinct from the shooting grip.

Figure 7:
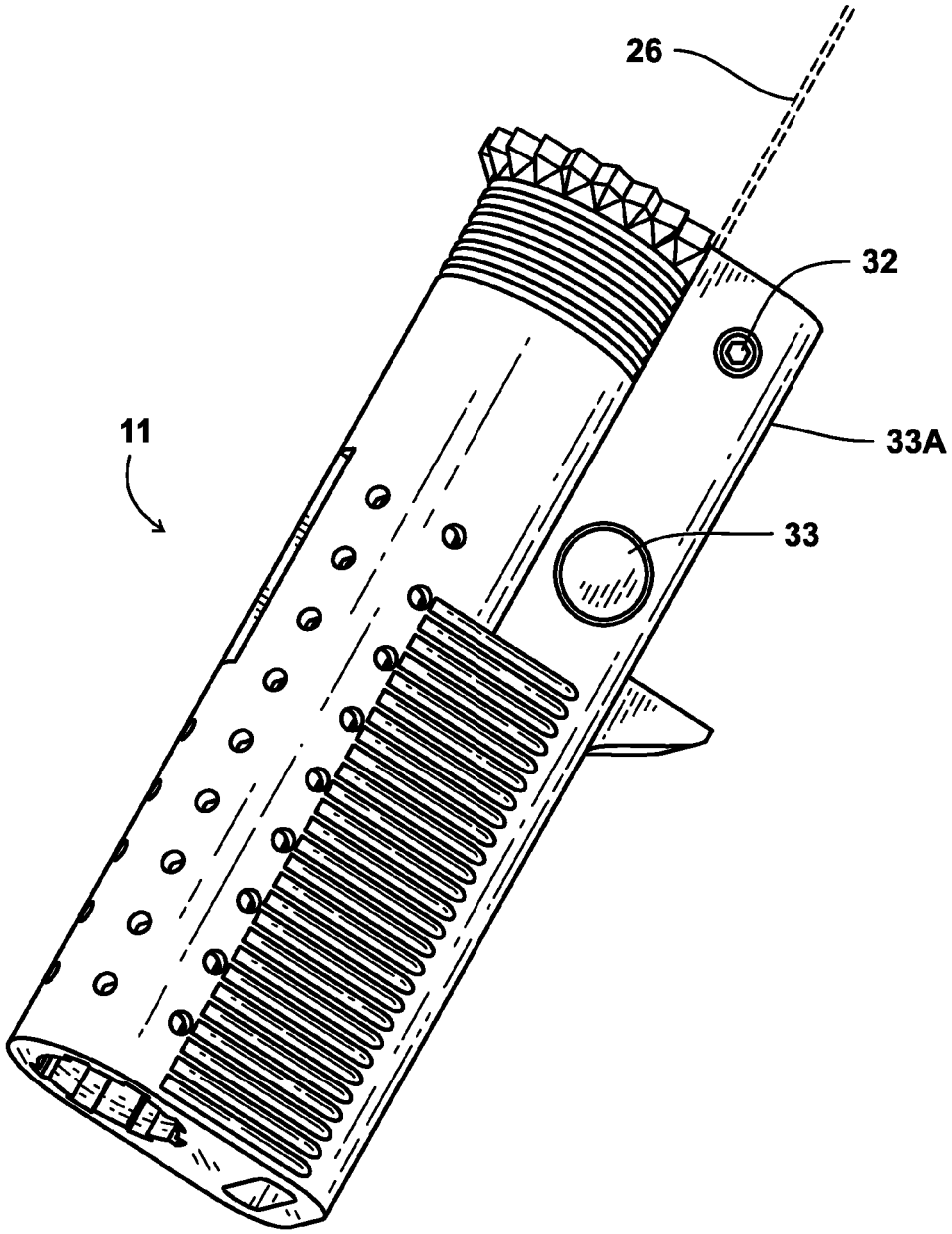
FIG. 7 is a side perspective view of an embodiment of the invention with a laser aiming device as an integral part thereof.

Referring to the FIG. 7 embodiment of the handgun device 11, a Laser Aiming Device 33A can be built in, rather than attached to a Rail (seen at 22 of the FIG. 1 embodiment). FIG. 7 also shows a Laser Light Beam 26, a Laser On-Off Switch 33 and a Laser Left-Right Adjustment Mechanism 32, placed on right side of the invention, it being understood that such an adjustment mechanism can be placed on either side. Embodiments can further include a laser up-down adjustment mechanism, which can be disposed on the bottom of the handgun device. In certain embodiments, the Adjustment Mechanism comprises a screw.

Figure 12:
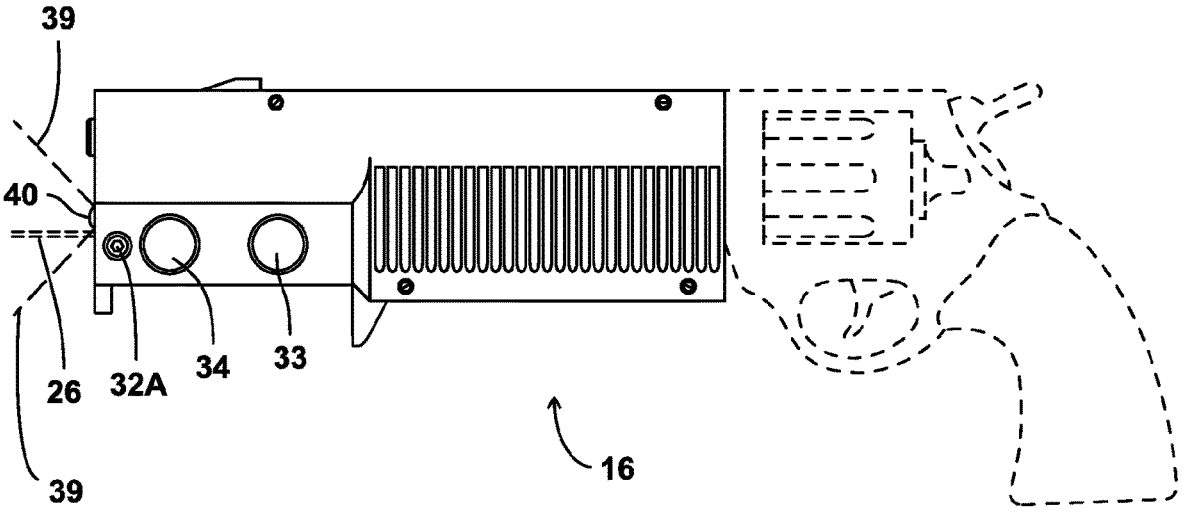
FIG. 12 is a side view of a clam-shell style embodiment of the invention wherein the left and right sides of the clam-shell are attached to the barrel of a revolver and where the invention includes a laser aiming device and a flashlight, each with its own switch, versus using a rail to mount a laser and flashlight to the invention.

In FIG. 12, an exemplary embodiment is shown that comprises a flashlight with light beams 39 extending therefrom. As shown in FIG. 12, the flashlight can be disposed on a firearm laser aiming device. The handgun device 16 can include a Flashlight Bulb Cover 40, a Flashlight On-Off Switch 34, or a combination thereof.

Figure 13:
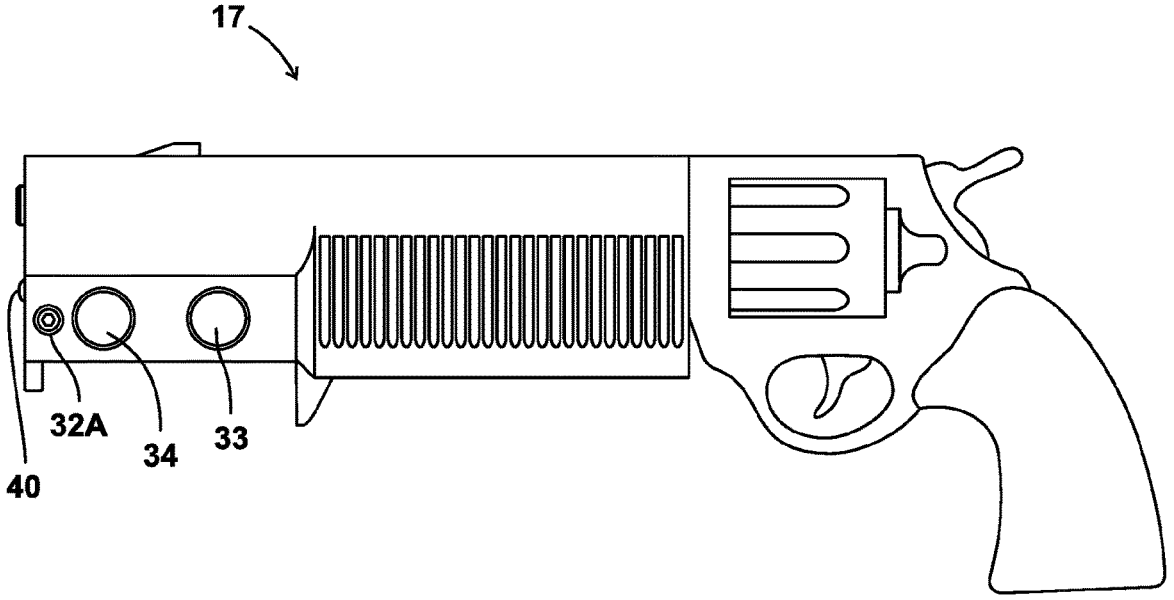
FIG. 13 is a side view of an embodiment of the invention where the invention's features have been built into a revolver as part of the revolver's original manufacture, and where the invention includes a laser aiming device and a flashlight, each with its own switch.

FIG. 13 shows the exemplary features of FIG. 12 built into a revolver, the handgun device being an integral part thereof 37A. In this embodiment, the revolver and invention can be originally manufactured together or provided as a single unit, as opposed to embodiments wherein the handgun device comprises an after-market product or otherwise configured to be reversibly attached to a previously manufactured revolver.

Figure 5:
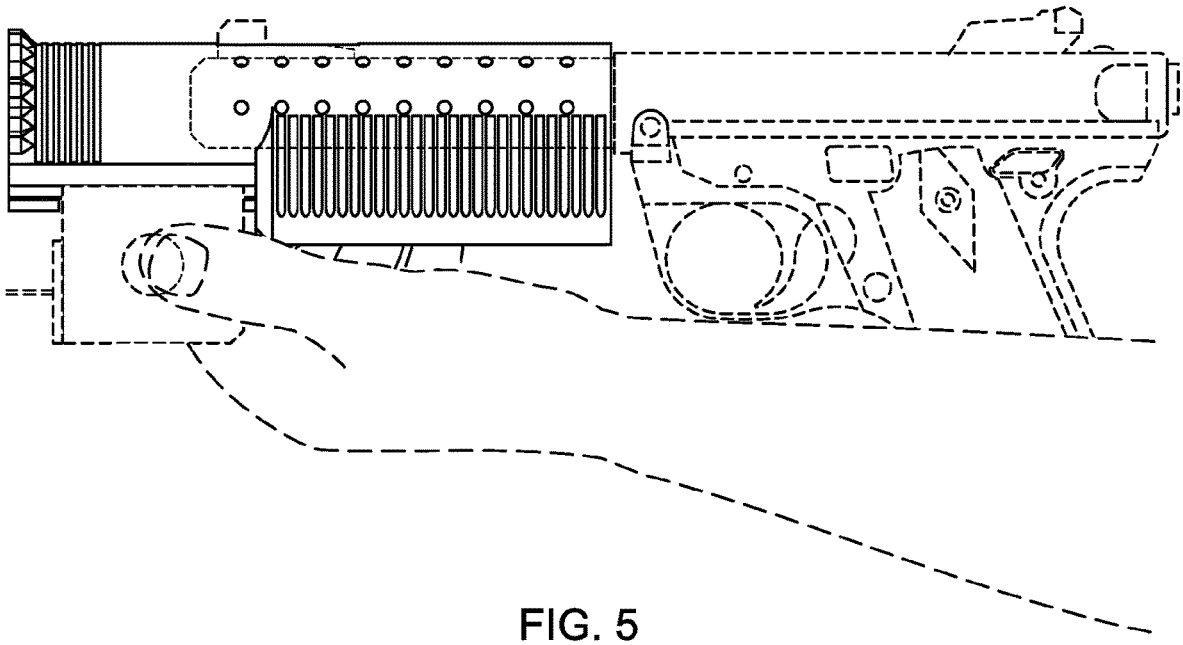
FIG. 5 is a left side view of an embodiment attached to a semi-automatic handgun and a laser aiming device mounted to the invention. In embodiments, neither the handgun nor the laser aiming device are part of the invention, with the user's hand on the device and the user's thumb on a switch of the laser aiming device.
Figure 6:
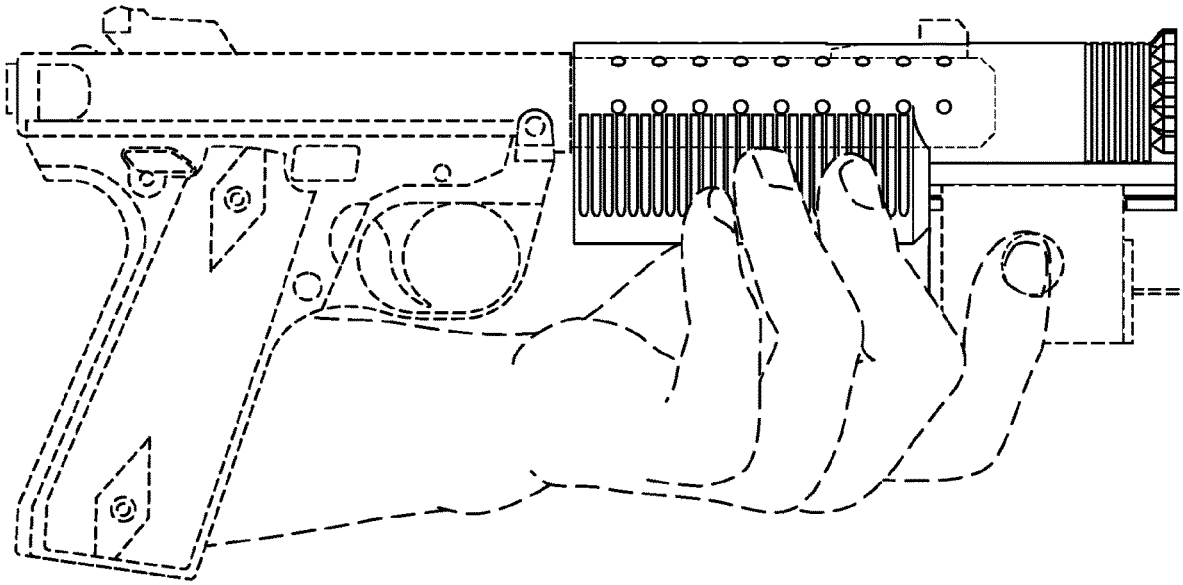
FIG. 6 is a right-side view of an embodiment attached to a semi-automatic handgun and a laser aiming device mounted to the invention. In embodiments neither the handgun nor the laser aiming device are part of the invention, with the user's hand on the device and the user's index finger on a switch of the laser aiming device.
Figure 8:
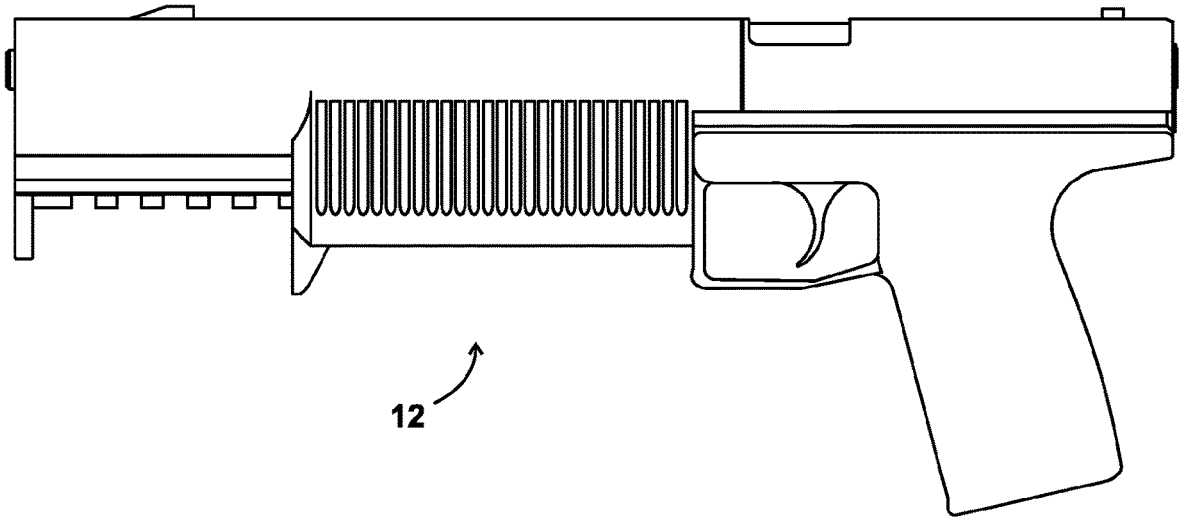
FIG. 8 is a side view of an embodiment of the invention where the invention's features have been built into a semi-automatic handgun as part of the gun's original manufacture, as opposed to the invention being attached to the handgun subsequent to its original manufacture.

As shown in the figures, the handgun device can be incorporated into a handgun's original manufacture (i.e., incorporated into the original manufacturing process for a handgun). Referring to FIG. 8, for example, an embodiment of the handgun device is shown where the device's features have been built into a semi-automatic handgun as part of the gun's original manufacture, as opposed to the invention being attached to the handgun subsequent to original manufacture (see FIGS. 5 and 6, for example).

Figure 9:
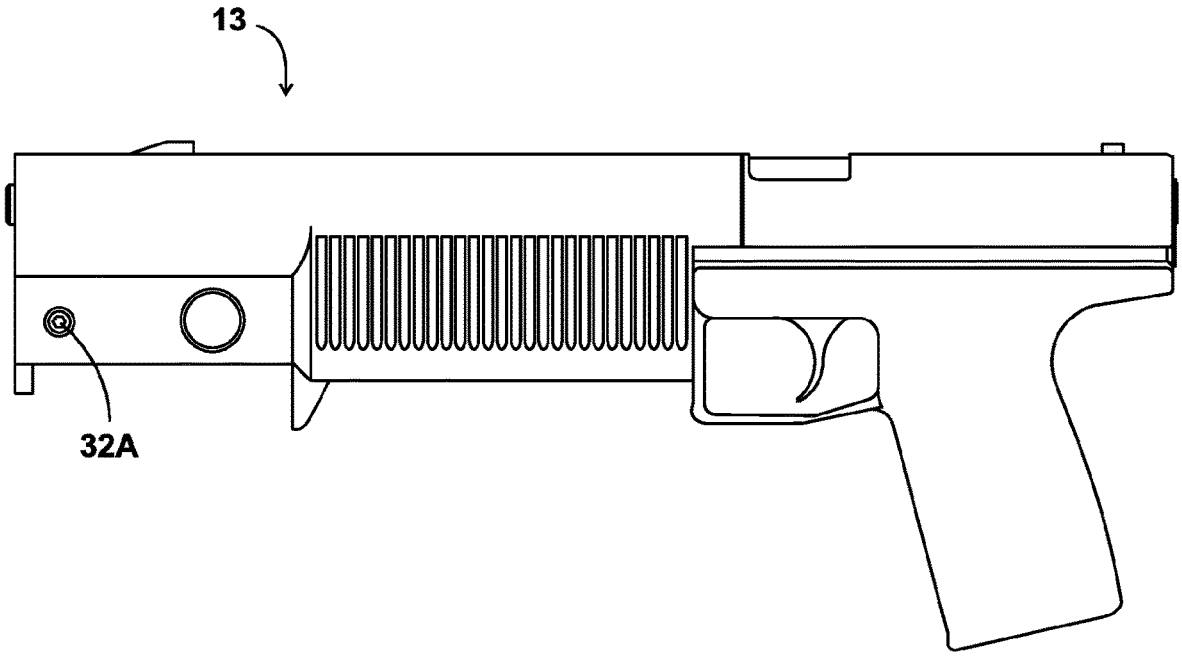
FIG. 9 is a side view of an embodiment of the invention where the invention's features have been built into a semi-automatic handgun as part of the gun's original manufacture, as opposed to the invention being attached to the handgun subsequent to its original manufacture, and where a laser is also a part of the originally manufactured handgun with the invention, as opposed to adding a laser subsequent to the handgun's original manufacture.

Similarly, FIG. 9 shows an embodiment where the handgun device's features have been built into a semi-automatic handgun as part of the gun's original manufacture, and where a laser is part of the originally manufactured handgun, with the Laser Left-Right Adjustment Screw 32A, placed on the left side of the invention. The FIG. 9 embodiment can further comprise a laser up-down adjustment screw which can be disposed on the bottom of the hand gun device.

Figure 3:
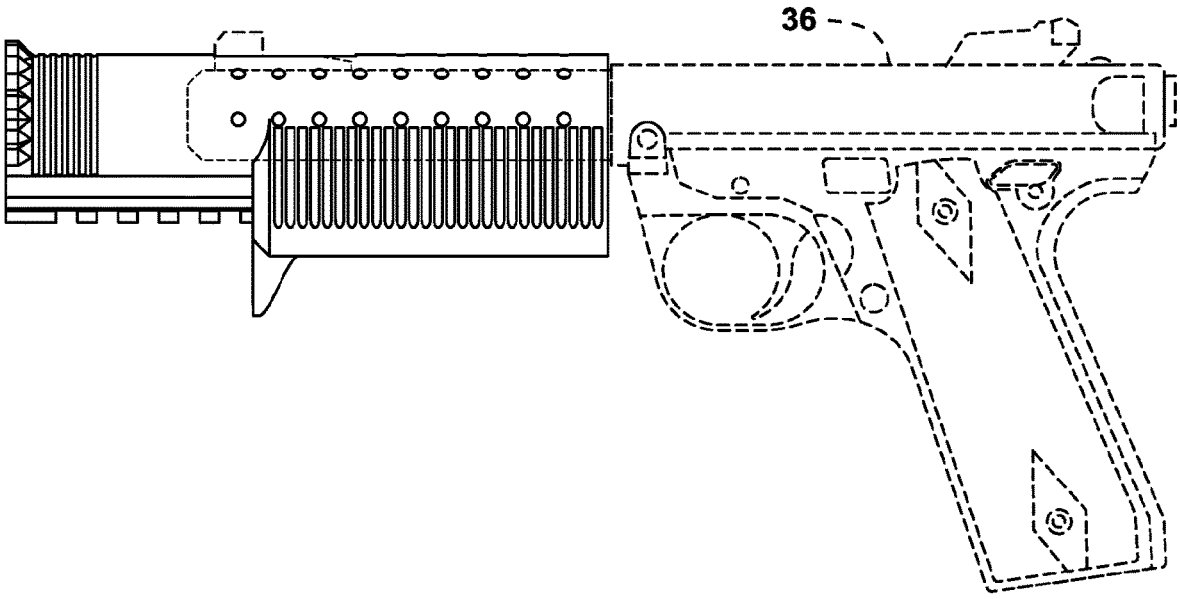
FIG. 3 is a left side view of an embodiment attached to a semi-automatic handgun. In embodiments, the handgun is not a part of the invention.
Figure 4:
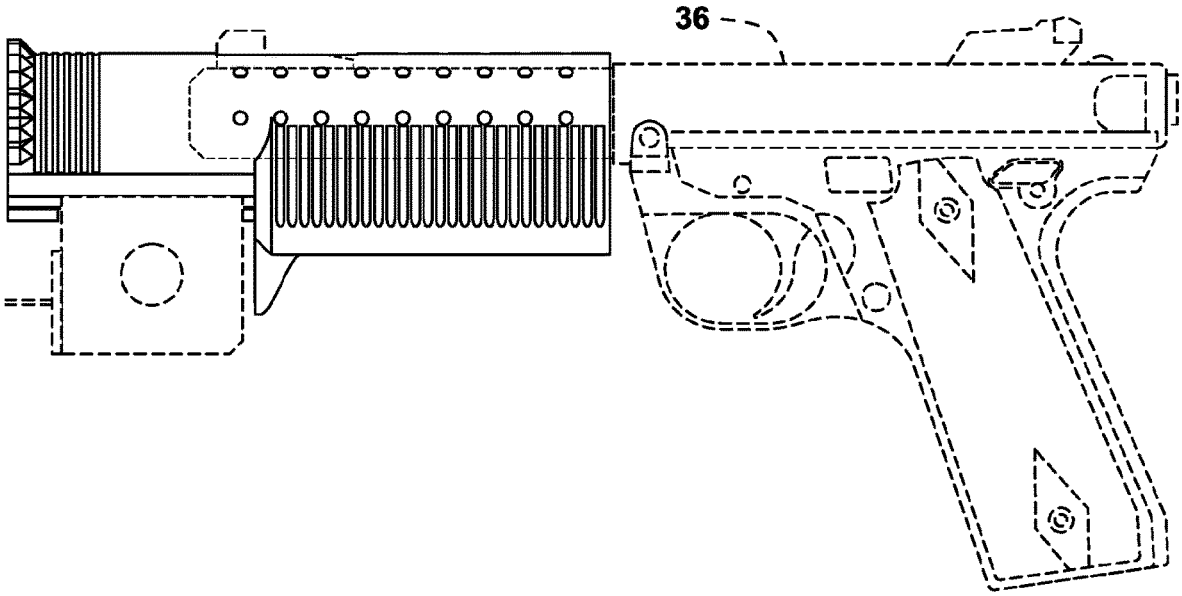
FIG. 4 is a left side view of an embodiment attached to a semi-automatic handgun and a laser aiming device mounted to the invention. In embodiments, neither the handgun nor the laser aiming device are part of the invention.

In other embodiments, the features of the handgun device can be manufactured to be attached as a handgun accessory to a manufactured handgun. Referring to FIG. 3, for example, a left side view of an embodiment attached to a semi-automatic handgun is shown. Similarly, FIG. 4, for example, is a left side view of an embodiment attached to a Semi-automatic Pistol 36 and a laser aiming device is mounted to the handgun attachment.

The skilled artisan will recognize that there are a number of ways to attach the handgun device to a manufactured handgun. This can depend on the handgun's design. For example, in one embodiment, the invention is placed under the barrel of the gun. For example, in another embodiment, the invention is placed around the barrel or forward portion of the handgun. In embodiments, the device can extend beyond the end of the barrel itself. For example, the device can extend beyond the barrel by one ore more inches, or any fractions thereof. In other embodiments, the device does not extend beyond the barrel. In other embodiments, the device encapsulates the muzzle as well.

Those skilled in the art of attaching accessories to handguns will readily observe that there are numerous ways to make this attachment, including slipping a one piece version of the invention snugly over the barrel of a gun. In embodiments, the handgun device is frictionally attached to a handgun when slid over the barrel. In embodiments, the device is attached under the barrel of the gun, such as attached by one or more attachment mechanisms. In embodiments, an attachment mechanism, such as one or more screws, pins or clips, can be used to secure the invention in place to the handgun, such as to the barrel of the handgun.

Figure 10:
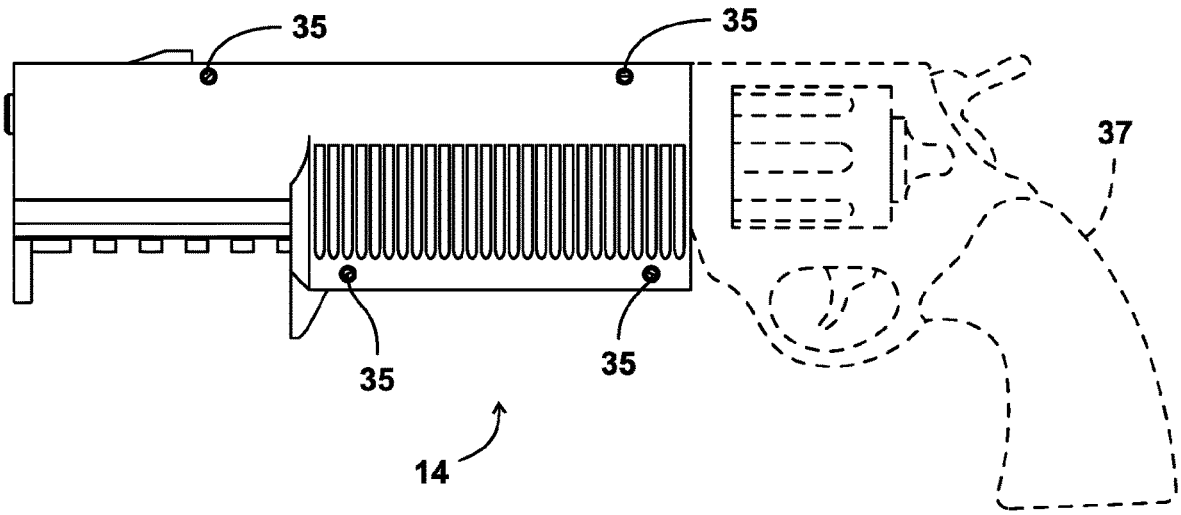
FIG. 10 is a side view of a clam-shell style embodiment of the invention wherein the left and right sides of the clam-shell are attached to the barrel of a revolver.

In another embodiment, the device can surround the barrel of the handgun with a two piece version of the device, such as clamshell style. In clamshell style embodiments, the handgun device can be secured by an attachment mechanism, such as one or more screws or clips. Referring to FIG. 10, for example, a clam-shell style embodiment of the invention is shown wherein the left and right sides of the clam-shell are attached to the barrel of a Revolver 37. Although the left and right sides of the invention are shown clamped onto the Revolver through the use of four Screws 35, any number of screws or alternate attachment mechanism can be appropriate. It is understood that the left and right sides of the invention can be clamped to the handgun with mechanisms known to the skilled artisan, including clamps, pins, spring-loaded, clips, and the like.

Figure 11:
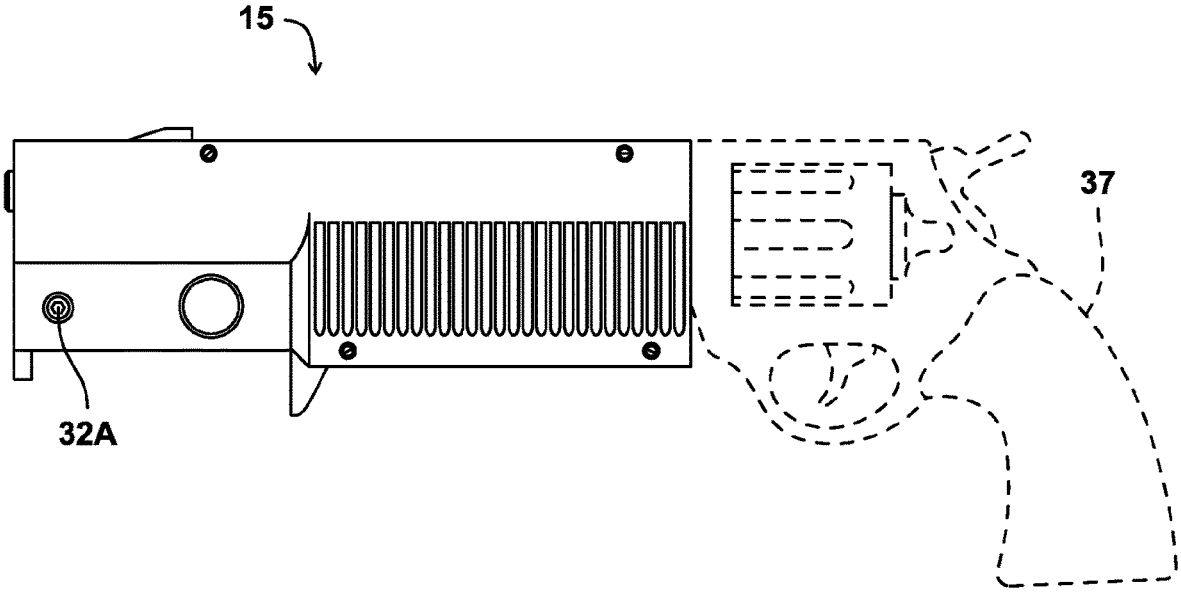
FIG. 11 is a side view of a clam-shell style embodiment of the invention wherein the left and right sides of the clam-shell are attached to the barrel of a revolver and where the invention includes a laser aiming device, versus using a rail to mount a laser to the invention.

FIG. 11 shows the clam-shell style embodiment of FIG. 10 but with an integral accessory such as a laser aiming device, versus mounting an accessory to the handgun attachment.

In embodiments, the handgun device can be formed, using either singularly or using any combination of hardwoods, metals, polymers, natural fibers, synthetic fibers, ceramics, and composite materials.

For example, the handgun device can be manufactured by injection molding, machining, stamping, deep forming, thermal vacuum molding, casting, drawing, forging, over molding, rotational molding, reaction injection molding, printing on a three-dimensional (3D) printer, etc.

Embodiments described herein are particularly suited for use by the those who suffer from frailties, for example weakened hand strength, poor finger dexterity, or weakened eyesight, such as those senior citizens and disabled citizens suffer from.

For example, the handgun device described herein makes it easier to control and/or use an accessory, such as a light, laser or camera. For example, the device herein can make it easier to control the laser aiming dot, or assist with flashlight use.

The handgun device described herein further places the user's fingers of the non-shooting hand right next to (immediately adjacent to) the controls (i.e., buttons, switches, or dials) of the accessories. This makes using the controls, such as ON-OFF or STEADY-FLASHING switches or buttons, easier to reach and operate, especially during the terrifying moments of a home invasion.

Furthermore, my invention provides excellent laser dot aiming control, for example even while shooting "from the hip," while simultaneously giving the user a clear field of vision of the surrounding environment. Experience indicates that the elderly and disabled are more comfortable and proficient with a handgun when they can control the gun and accessories while still maintaining a clear view of the surrounding environment. Indeed, comfort and proficiency boosts confidence, the importance of which cannot be overstated if an elderly or disabled person is forced to defend herself or himself during a home invasion.

To operate the embodiments of the device, the dominant shooting hand grabs the grip of the handgun in the ordinary fashion with the index finger on the trigger. The fingers of the non-shooting hand can then rest on the Finger-Rest Area of the handgun device with either the index finger or thumb temporarily engaging the controls of the accessory, such as the switches on the laser, flashlight, camera, or other electronics. After engaging said switches the index finger or thumb of the non-shooting hand may then return to the Finger-Rest Area. See, for example, FIGS. 5 and 6.

Figure 14:
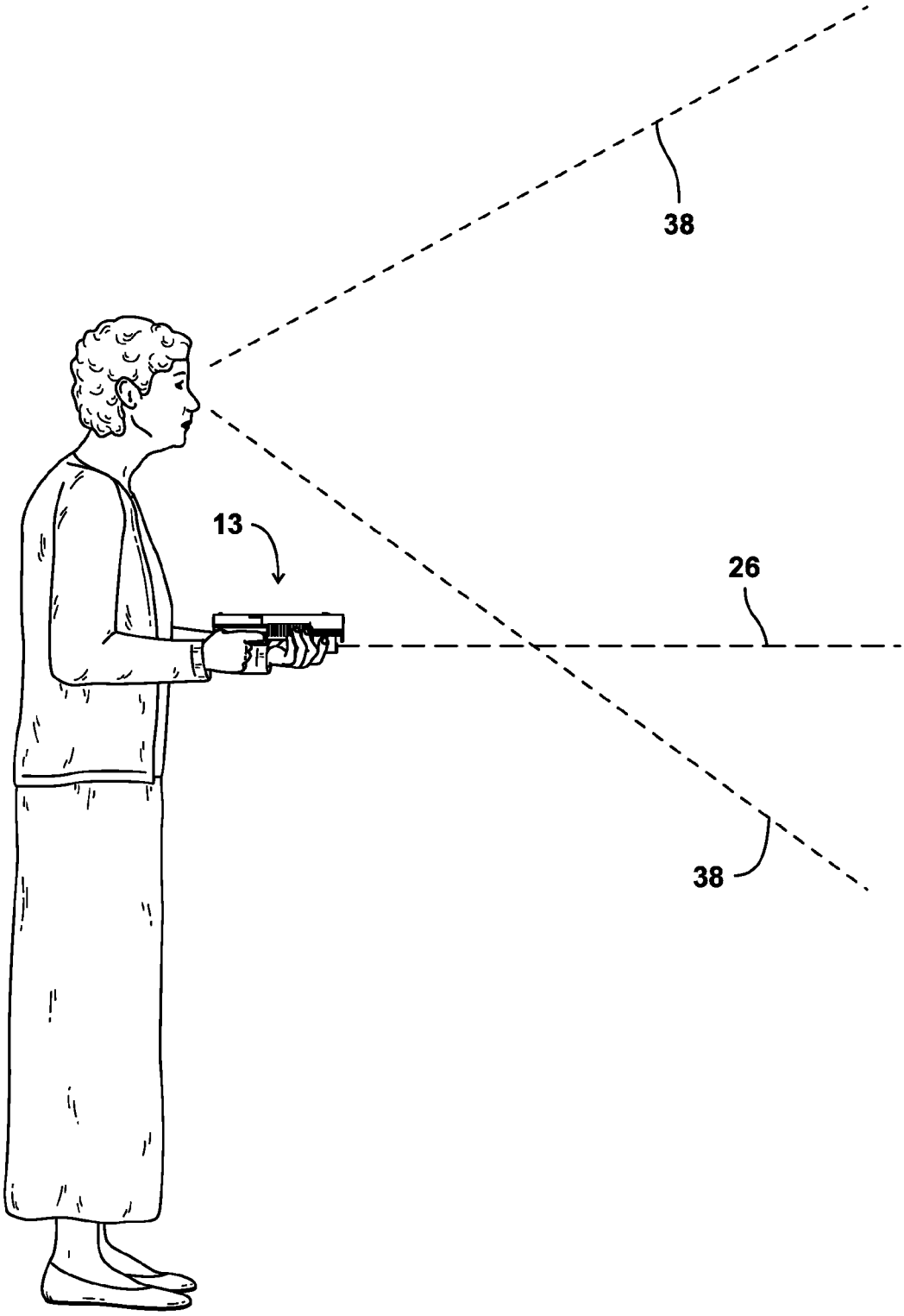
FIG. 14 shows a side view of a semi-automatic pistol embodiment of the invention in an exemplary environment of use. In this particular view, a senior individual controls the handgun "from the hip," thereby affording her an unobstructed view of the entire room.

Then, while the shooting hand grasps the gun's grip and the index finger is on the trigger, the non-shooting hand can manipulate the handgun device up, down, left or right, for example, to point the laser light. For example, manipulation of the position of the device can bring the laser aiming dot to the target. This may be accomplished with such ease that the handgun can be fired from the hip, thereby achieving great accuracy while still affording the user a comfortable view of the surrounding environment. FIG. 14 refers to, for example, an embodiment of the handgun device being used, such as where the senior controls the handgun "from the hip," thereby affording her an unobstructed Line Of Sight 38 of the entire surrounding environment.

EXAMPLES

Examples are provided below to facilitate a more complete understanding of the invention. The following examples illustrate the exemplary modes of making and practicing the invention. However, the scope of the invention is not limited to specific embodiments disclosed in these Examples, which are for purposes of illustration only, since alternative methods can be utilized to obtain similar results.

Example 1

Figure 15:
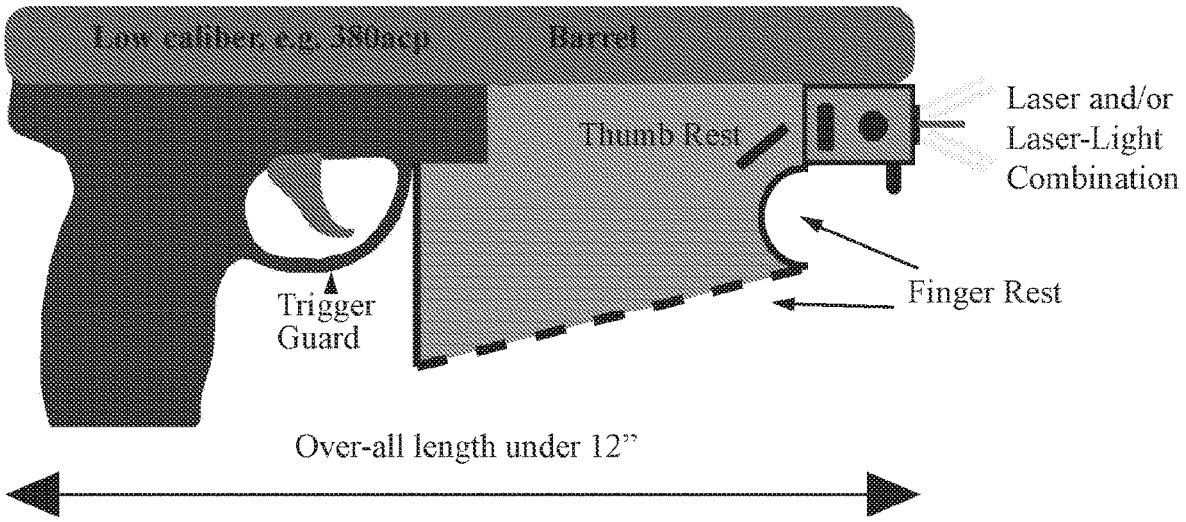
FIG. 15 shows a schematic illustration of an embodiment of the invention and not necessarily to scale.

Aspects of this invention are drawn to a pistol that is easy for senior citizens and those with disabilities, such as muscle weakness or vision problems, to use for Home Defense. Not a "carry" firearm, but rather, to be kept in the home, such as in the bedroom. FIG. 15, for example, refers to a schematic illustration of an embodiment of the invention and not necessarily to scale.

Thumb Rest and Finger Rest are forward of Trigger Guard and below gun barrel. Thumb Rest can be a protrusion the thumb rests upon, or integrated into the Finger Rest area. Finger Rests are serrated or crosshatched to prevent slippage, and the bottom edge of Finger Rest can be angled. Laser and/or Laser-Light Combination is forward of Thumb Rest and Finger Rest and below Barrel. Laser or Laser-Light Combination has controls represented by solid black shapes thereon.

Key Elements comprise:

1. Low recoil, partially because of low caliber, e.g., 380acp vs 440 CorBon.
2. Laser and or light module on unit initially, or user adds one of his preference.
3. Easy to aim—just point the laser—no need to squint at steel sights.
4. Thumb Rest and Finger Rest make it easy to manipulate controls on Laser-Light.
5. Over-all length less than 12"
6. Weight under 6 lbs.

Example 2

Parts List of Embodiments described herein:

NUMBER DESCRIPTION

10 Invention As A Pistol Attachment
11 Invention With Built In Laser As A Pistol Attachment
12 Semi Auto Pistol With Invention As An Integral Part Of Pistol
13 Semi Auto Pistol With Invention And Laser As Integral Parts Of Pistol
14 Invention As A Revolver Attachment
15 Invention With Built In Laser As A Revolver Attachment
16 Invention With Built In Laser And Light As A Revolver Attachment
17 Invention With Laser and Light As Integral Parts of Revolver
20 Front Sight Cut Out
22 Rail
23 Forward Finger Stop
24 Rear Finger Stop
25 Finger Rest Area
26 Laser Light
27 Ventilation Hole
28 Linear Ventilation Channel
28A Lower Ventilation Channel
289 Circular Ventilation Channel
29 Ventilation Connector
30 Barrel Contact
31 Rear Air Intake

32 Laser Left-Right Adjustment Screw When Placed On Right Side
32A Laser Left-Right Adjustment Screw When Placed On Left Side
33 Laser On-Off Switch
33A Laser Aiming Device
34 Light On-Off S witch
35 Screws
36 Semi-Automatic Pistol
37 Revolver That Invention Is Attached To, not part of actual invention.
37A Revolver With Invention As Integral Part Thereof
38 Line Of Sight
39 Light From Flashlight
40 Flashlight Bulb Cover

EQUIVALENTS

Those skilled in the art will recognize, or be able to ascertain, using no more than routine experimentation, numerous equivalents to the specific substances and procedures described herein. Such equivalents are considered to be within the scope of this invention, and are covered by the following claims.

What is claimed:

1. A device in combination with a handgun having a substantially exposed barrel and lacking a forward grip, comprising:

a hollow chamber;

a horizontal Finger Rest Area;

a fastener;

a rail; and a laser device, wherein the device does not comprise a vertical grip;

wherein the handgun includes a trigger, a grip, a muzzle, and a barrel having a substantially exposed portion not enclosed within a slide or a frame;

wherein the hollow chamber receives the substantially exposed portion of the barrel;

wherein the horizontal Finger Rest Area is forward of the trigger and rearward of the muzzle;

wherein the device is configured to be grasped by a user having a non-shooting hand and a shooting hand such that the user grasps the horizontal Finger Rest Area with the non-shooting hand;

wherein the device is configured such that the non-shooting hand directs a laser emanating from the laser device;

wherein the handgun is configured to be fired by the shooting hand as the user grasps the grip of the handgun with the shooting hand, and a finger of the shooting hand pulls the trigger;

wherein the fastener affixes the device to the handgun; and wherein the rail is configured to receive the laser device.

2. The device of claim 1, further comprising a flashlight, wherein the rail is configured to receive at least one of the laser device and the flashlight.

* * * * *